United States Patent [19]

Cote

[11] 4,185,764

[45] Jan. 29, 1980

[54] SNAP-UP BOTTOM, FLAT FOLDED SCOOP-TYPE CARTON

[75] Inventor: Raymond A. Cote, Taylorville, N.C.

[73] Assignee: Champion International Corporation, Stamford, Conn.

[21] Appl. No.: 958,185

[22] Filed: Nov. 6, 1978

[51] Int. Cl.[2] ..... B65D 5/36; B65D 5/08

[52] U.S. Cl. ..... 229/16 R; 229/41 B; 229/1.5 B

[58] Field of Search ..... 229/41 B, 16 R, 8, 1.5 B

[56] References Cited

U.S. PATENT DOCUMENTS

| | | | |
|---|---|---|---|
| 2,078,038 | 4/1937 | Stephens | 229/16 R X |
| 2,337,199 | 12/1943 | Holy | 229/16 R |
| 2,385,898 | 10/1945 | Waters | 229/1.5 B X |
| 3,630,430 | 12/1971 | Struble | 229/41 B X |
| 3,684,157 | 8/1972 | Mendez | 229/16 R |
| 3,845,897 | 11/1974 | Buttery et al. | 229/41 B X |
| 3,877,632 | 4/1975 | Steel | 229/41 B |
| 3,971,503 | 7/1976 | Allan et al. | 229/41 B X |

*Primary Examiner*—Davis T. Moorhead
*Attorney, Agent, or Firm*—Evelyn M. Sommer

[57] ABSTRACT

A flat, folded carton having a snap-up bottom for erection into a generally conical hollow container includes a bottom panel of generally octagonal configuration, and two upstanding side wall panels interconnected by end walls. One side panel is of isosceles trapezoidal shape, while the other side panel is of isosceles triangular shape. The end walls are hingedly connected to the isosceles triangular wall panel, and bonded by a glue strip to the isosceles trapezoidal panel. The resulting container configuration is generally conical, with the planes of the side wall panels extending upwardly and divergently from the bottom panel. Hence, the carton provides an enlarged bell mouth opening for the generally conical hollow container, thereby facilitating the scooping and loading of products into the container.

8 Claims, 5 Drawing Figures

SNAP-UP BOTTOM, FLAT FOLDED SCOOP-TYPE CARTON

The subject invention relates to cartons, and more specifically to cartons of the type including scored fold lines on the end and bottom wall panels so that they may be readily expanded from flat to set-up position. More particularly, the subject invention relates to a paper-board container which may be readily expanded from flat to set-up position, and which has an enlarged top or bell-mouth opening for facilitating the scooping up of items to be carried by the container, and with the container having inherent means for maintaining its erected position for holding the items until they are removed.

Heretofore it has been known on the prior art to provide flat-folded paperboard containers which may be erected, and which include front and back side walls that are usually of the same configuration, and in the erected condition of the carton, are disposed in parallel relationship. Accordingly, the resulting container is generally rectangular in configuration, and generally has the same cross-sectional shape at the inlet or open portion of the container as at the bottom or base of the container. As is readily apparent, in a scooping operation wherein the container is scooped into a product, the size of the inlet opening is of importance in insuring the rapid and unobstructed loading of the products.

It is thus an object of the subject invention to provide a new and improved flat-folded, scoop-type carton of new and unique construction whereby the erected carton is self-supporting and the resulting carton configuration includes an enlarged bell-mouth opening thereby facilitating the scooping or loading of the container.

During the erection of the carton which is formed of a single blank of paperboard material, the carton is erectable into use position by merely snapping the folded bottom panel upwardly into place, at which time the carton assumes a generally hollow, conical configuration. At such time, the planes of the front and back panels of the carton are in diverging relationship, and extend from the closed bottom panel, thus resulting in the desired conical configuration of the carton.

The present invention is also directed to a carton blank formed of a single sheet of paperboard material, and scored to define front and back panels, side panels, and a bottom panel, along with glue strips for construction of the snap-up bottom, flat folded scoop-type carton.

These and other features of novelty of the invention will be described in the accompanying specification and illustrated in the drawings, certain preferred features being shown by way of example only, for since the underlying principles may be incorporated in other paper-board structures, it is not intended to be limited to the forms here shown, except as such limitations are clearly imposed by the appended claims.

In the drawings, like numerals refer to similar parts throughout the several views, of which:

Figure 1:
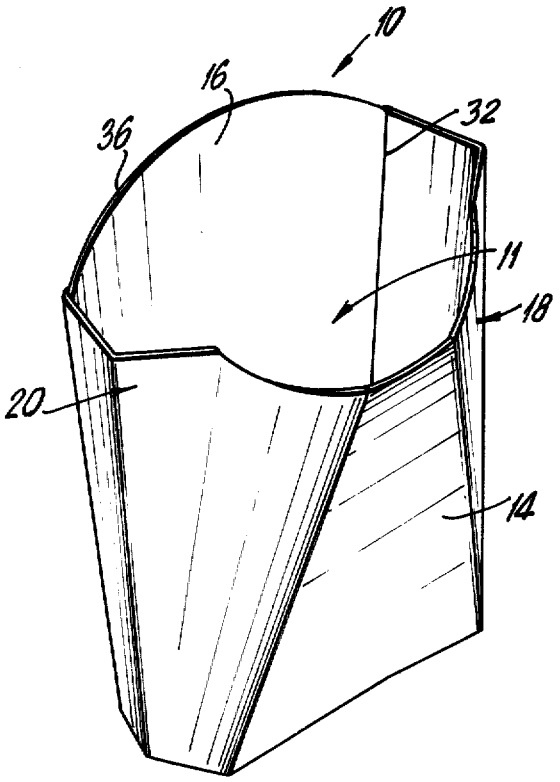
FIG. 1 is a perspective view of the subject scoop-type carton in set-up position ready for the scooping and insertion of a product therein.
Figure 4:
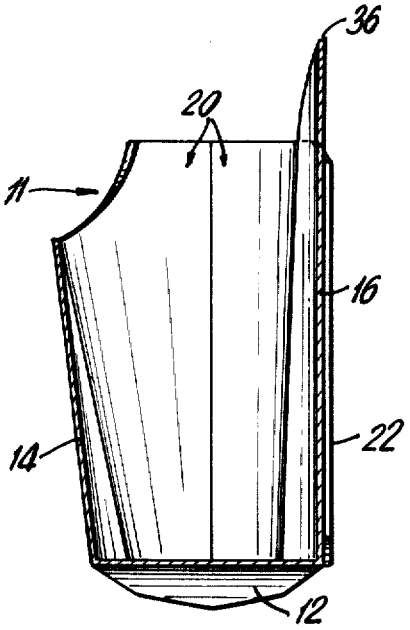
FIG. 4 is a sectional view of the subject carton taken along line 4—4 in FIG. 3.

Referring to FIGS. 1 through 4, the new and improved scoop-type carton of the subject invention is generally designated by the numeral 10, and in its erected condition is of hollow, conical configuration, having an open bell-mouth 11 at one end, and a closed bottom end 12 at the opposite end. Carton 10 further includes opposed side walls 14 and 16 which are interconnected by means of opposed end wall panels 18 and 20, with glue strips 22 and 24 being respectively hingedly connected to the opposed end wall panels 18 and 20 and overlying and being bonded to the opposed edges of the side wall 16, as more clearly illustrated in FIG. 3. As shown in FIG. 1, in the erected condition of the carton 10, the bell-mouth opening 11 facilitates the scooping of products, such as food items, into the carton, and the snap-up bottom panel 12 (see FIG. 2) insures that the carton is maintained in its set-up condition. As illustrated in FIG. 4, the planes of the opposed side walls 14 and 16 diverge and extend from the bottom wall 12 of the erected carton.

Figure 5:
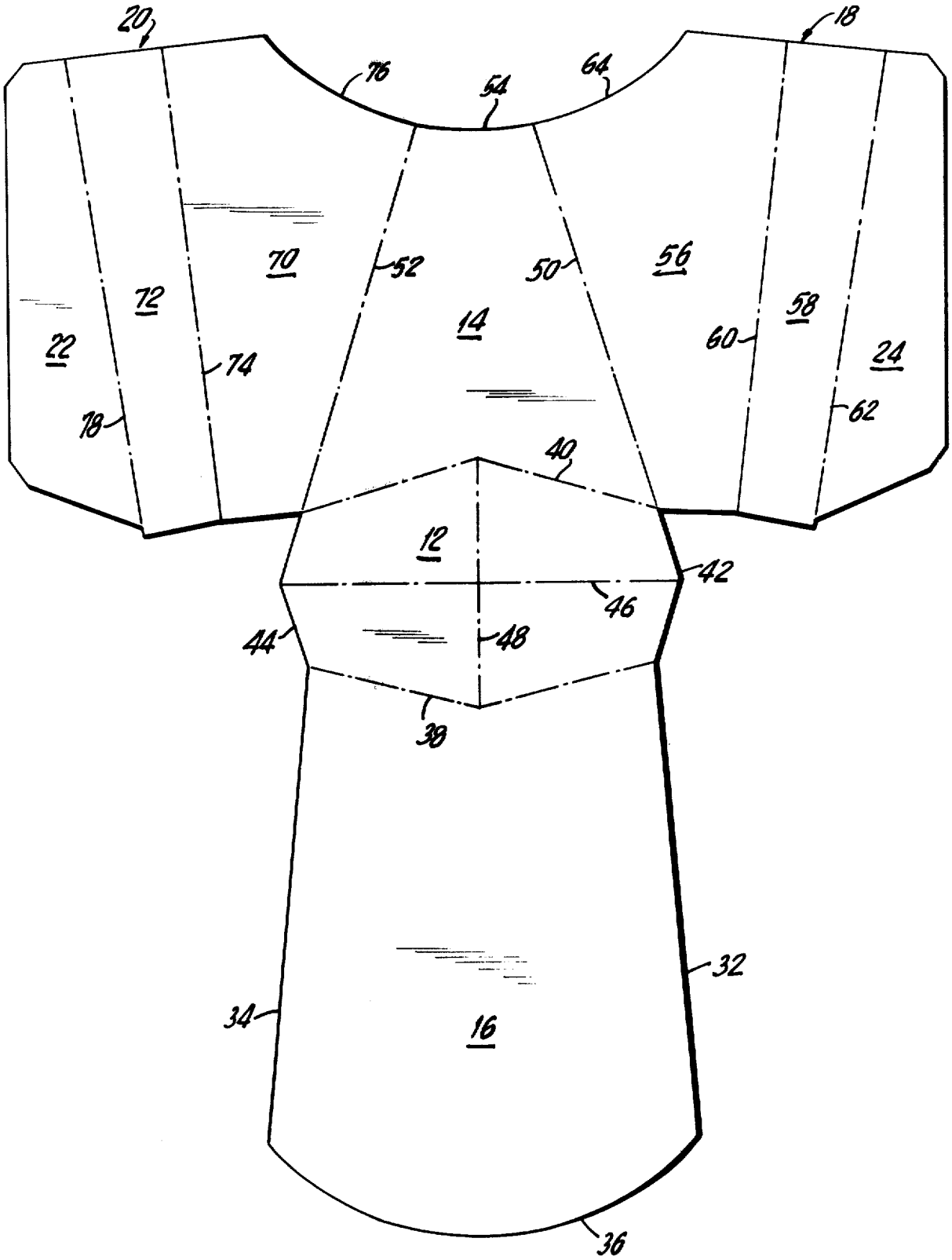
FIG. 5 illustrates the blank of the carton in accordance with the present invention.

Carton 10 is preferably formed from a single blank of foldable paperboard material, of a configuration as illustrated in FIG. 5. The first side wall panel 16 is of substantially isosceles trapezoidal shape including two diverging sides 32 and 34, and a top or free edge 36 which is of arcuate convex configuration. The first side wall panel 16 is hingedly connected to the snap-up base 12 along hinge line 38. The bottom panel 12 is of generally elongated, octagonal configuration, two side walls of which form the hinge line 38, while the opposite two side walls form hinge line 40. The remaining four sides of elongated bottom panel 12 define opposed edges 42 and 44. The bottom panel 12 is bisected by a longitudinally extending score line 46, while the minor dimension of the bottom panel 12 is bisected by a second score line 48 which is disposed perpendicular to score line 46.

The second side wall panel 14 of carton 10 is hingedly connected to the elongated bottom panel along hinge line 40, and is of generally isosceles triangular shape, including two converging side edges, designated by the numerals 50 and 52. The free edge 54 of panel 14 is of arcuate concave configuration. The end wall panels 18 and 20 are respectively hingedly connected to the second side wall panel 14 along fold lines 50 and 52. The base of first side wall panel 16 defines an upper edge of the opening in the container while the vertex thereof is disposed adjacent the bottom panel 12. Conversely, the base of the second side wall panel 14 is disposed adjacent the bottom panel 12 while the vertex thereof defines an upper edge of the opening in the container. Thus, since the pairs of sides or edges 32, 34 and 50, 52 converge in opposite directions with respect to each other, the first and second side wall panels 14 and 16 are inverted with respect to each other when the carton 10 is erected, as will later become apparent. End wall panel 18 includes two portions 56 and 58 hingedly connected along fold line 60 disposed intermediate the fold line 50, and the fold line 62 connecting the end wall panel 18 to the glue strip 24. The panel portion 56 is of generally triangular configuration, with the free end thereof including an arcuate portion 64 which fairs into the arcuate concave edge 54 of the side wall panel 14. Similarly, end wall panel 20 includes two panel portions 70 and 72 hingedly connected along fold line 74, with the triangular panel portion 70 including an arcuate free edge 76.

The glue strip 22 is hingedly connected to the panel portion 72 of end wall 20 along fold line 78.

In the assembly of the carton 10, the glue strips 22 and 24 are folded about the fold lines 78 and 62 so as to overlap the outside surface of the side wall 16, with the edges 32 and 34 being respectively aligned with the fold lines 62 and 78. In such position, the glue strips 22 and 24 are adhesively bonded to the side wall panel 16. By virtue of the longitudinally extending fold line 46 in the bottom panel 12, and the intermediate fold lines 60 and 74 in the end wall panels 18 and 20, the assembled carton may be folded to the flat configuration for easy storage. At such time, the opposed side walls 14 and 16 are in abutting relationship, and the panel portions 56, 58 and 70, 72 of the end walls 18 and 20 are likewise in abutting relationship.

Figure 2:
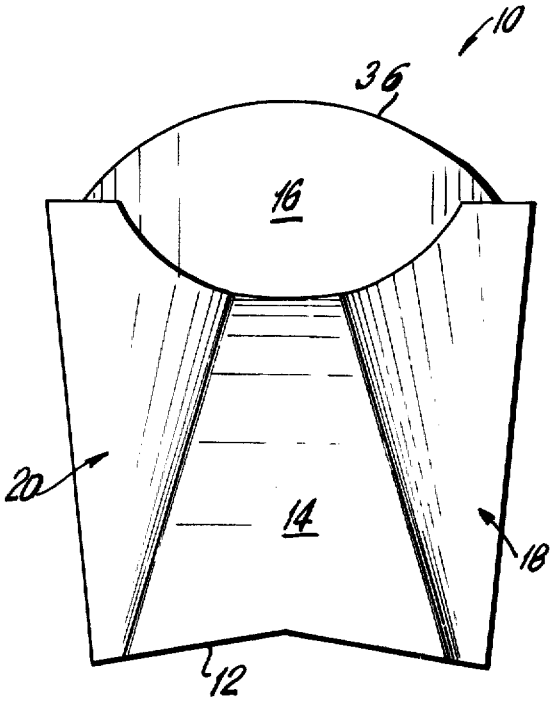
FIG. 2 is a frontal elevational view of the carton of FIG. 1.
Figure 3:
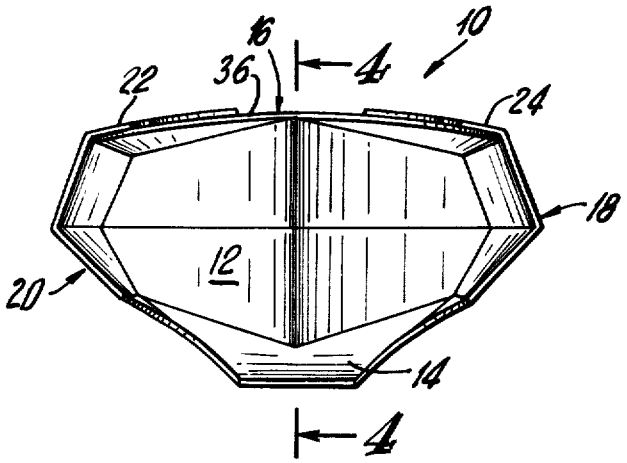
FIG. 3 is a top plan view of the carton of FIG. 1.

In order to erect the carton 10, it is merely necessary to separate the panel portions 14 and 16, and simultaneously snap up the base panel 12 whereby the latter assumes the angled configuration illustrated in FIG. 2, about the fold line 48. In such position, the angled configuration of the bottom panel, working in conjunction with the erected carton maintains the carton in its set-up condition, at which time the enlarged bell-mouth opening 11 is provided to facilitate scooping of contents into the carton. Also, the planes of the side wall panels 14 and 16 diverge as they extend away from the bottom panel 12.

It will thus be seen, and with particular reference to the showings of FIGS. 1 through 4, that a flat-foldable conical container of paper-board can be made with a snap-up bottom by suitably configuring a paperboard blank to include a generally octagonal bottom portion having longitudinally extending and laterally extending fold lines, opposed side walls, one of which is of isosceles trapezoidal shape, while the other is of isosceles triangular shape, as well as bellows-type intermediate end panels to provide a snap-up container of erected, conical shape. The containers may be made of a parafin paperboard or of paper-board provided with inner facings of liquid-type material, including various plastic materials in film form, or coatings sprayed or flowed in place on the inner surfaces of the finished containers.

It will be apparent that modifications or alterations in accordance with the present invention can be made by those skilled in the art without departing from the scope and spirit thereof, and it is equally apparent that the assembly involving the application of glue and folding of the carton blank may be rearranged in order to accomplish in the order of accomplishing these steps without departing from the scope of the invention. Thus, it will be obvious to those skilled in the art that various changes may be made without departing from the scope of the invention and the invention is not to be considered limited to what is shown in the drawings and described in the specification.

What is claimed is:

1. A flat folded, snap-up bottom type container capable of being erected into a generally hollow, conical configuration having an enlarged bell-mouth opening, comprising:

a generally elongate, polygonally shaped bottom panel forming one end of said container and having a pair of intersecting score lines therein;

first and second opposed side panels respectively hingedly connected to opposite elongate edges of said bottom panel and extending upwardly away from the latter toward the other end of said container, said second side panel including a pair of opposed lateral edges converging toward each other in a direction away from said bottom panel to form a generally isosceles triangularly shaped configuration having the base thereof adjacent said bottom panel and the vertex thereof adjacent said other end of said container, said first side panel including a pair of opposed lateral edges diverging away from each other in a direction toward said other end of said container to form a generally isosceles triangularly shaped configuration having the base thereof adjacent said other end of said container and the vertex thereof adjacent said bottom panel, said first and second panels being geometrically inverted with respect to each other whereby to form said enlarged bell-mouth opening; and a pair of end panels respectively hingedly connected both to said first and second side panels for enclosing the sides of the container.

2. The container of claim 1, wherein said end panels each comprise a first and second portion divided by a score line and extending in respective planes oblique to each other, each of said first portions being generally triangular in shape and having one edge thereof hingedly connected to the corresponding converging lateral edge of said second side panel.

3. The container of claim 2, wherein said vertex of said second side panel is truncated by edge portions thereof extending oblique to each of said converging lateral edges thereof, and said first portions of each of said end panels includes an arcuate edge extending away from the corresponding second portion and toward said second side panel, said arcuate edge registering with said edge portions of said second side panel and at least partially defining said enlarged, bell mouth opening of said container.

4. The container of claim 1, including a pair of glue strips respectively hingedly connected along one edge of said second portions of said end panels, said glue strips overlapping exterior surface areas of said first side panel and secured to the latter.

5. A blank comprising a single sheet of paperstock for forming the container of claim 1.

6. A blank comprising a single sheet of paperstock for forming the container of claim 2.

7. A blank comprising a single sheet of paperstock for forming the container of claim 3.

8. A blank comprising a single sheet of paperstock for forming the container of claim 4.

* * * * *